United States Patent [19]

Saulle

[11] Patent Number: 4,979,652

[45] Date of Patent: Dec. 25, 1990

[54] CHARGING VALVE FOR CONTAINERS OF FLUID PRODUCTS

[75] Inventor: Lorenzo Saulle, Pieve Emanuele, Italy

[73] Assignee: Stacos Di Saulle Lorenzo E Pontarollo Luciana S.n.c., Milan, Italy

[21] Appl. No.: 482,024

[22] Filed: Feb. 15, 1990

Related U.S. Application Data

[63] Continuation of Ser. No. 212,930, Jun. 29, 1988, abandoned.

[30] Foreign Application Priority Data

Jul. 2, 1987 [IT] Italy ..... 21941/87[U]

[51] Int. Cl.[5] ..... B65D 83/00

[52] U.S. Cl. ..... 222/402.16; 222/402.18; 222/389; 141/20; 137/853

[58] Field of Search ..... 222/399, 389, 386, 386.5, 222/402.1, 402.16, 402.18, 129; 141/20; 137/853, 860

[56] References Cited

U.S. PATENT DOCUMENTS

| | | | |
|---|---|---|---|
| 3,207,385 | 9/1965 | Featherstone et al. | 222/389 |
| 3,365,105 | 1/1968 | Krizka | 137/853 X |
| 3,674,185 | 7/1972 | Evesque | 141/20 X |
| 4,108,219 | 8/1978 | Shulsinger | 141/20 X |
| 4,877,157 | 10/1989 | Saulle | 222/402.1 X |

*Primary Examiner*—Andres Kashnikow
*Assistant Examiner*—Gregory L. Huson
*Attorney, Agent, or Firm*—Bucknam and Archer

[57] ABSTRACT

A valve to be installed on containers for fluid materials is formed by two coaxial chambers (3) and (4) one of which is internal (3), contains the fluid material and is equipped with a movable piston (10) and a discharging valve (7) including at least one "bypass" hole (8) which connects the two coaxial chambers (3) and (4) in the area between the maximum level of the fluid (18) and the discharging valve (7). An elastic sheath or rubber ring (5) is provided to close and wrap tightly the hole (or holes) (8).

2 Claims, 2 Drawing Sheets

CHARGING VALVE FOR CONTAINERS OF FLUID PRODUCTS

This is a continuation of application Ser. No. 07/212,930 filed June 29, 1988 and which is now abandoned.

BACKGROUND OF THE INVENTION

1. Field of the Invention

The present invention relates to a valve for the introduction of fluid materials into containers. More specifically, the invention relates to a valve for the introduction of fluid materials into containers when the propeller is a gas or compressed air. The propeller is separated from the product to be discharged.

2. Description of the Related Art

It is known to discharge fluid or liquid products in general by using containers like aerosol bottles or similar where the fluid products are mixed with an inert gas under pressure; the latter serves the function of a propeller to guarantee the expulsion of the material during its use. Since these containers in particular, due to environmental conditions, for example in presence of heat, may become dangerous and the gas used, even if harmless to people, may deteriorate the atmosphere, new containers have been proposed in which the gases are kept separated from the fluid materials and are injected in sealed chambers in which action on the materials to be expelled is exerted indirectly by a pressure piston. These containers are generally constituted by two chambers or concentric tanks formed by two tubular coaxial bodies inserted one inside the other and hermetically sealed at the top and at the bottom. The two tubular bodies form an inner chamber and an external chamber. In the inner chamber which is equipped with a discharging valve and a movable piston, is placed the fluid to be discharged. The propeller gas is placed in the external chamber under pressure. The gas, through the radial holes present on the lower part of the tubular internal body acts on the bottom of the piston. In these containers the introduction of the fluid or liquid material is obtained by injection, with special syringes through the same valve which is used for the expulsion of the material. The introduction of the pressurized gas in the circular external chamber is obtained through a special small valve preferably placed at the bottom of the container. This system of dual charging, even if valid from a technical and functional point of view, presents considerable drawbacks. In fact, the containers must have two separated valves of different types with special technical devices for their production and application in addition to particular working requirements for the containers themselves.

These facts increase the production cost and, of course, unfavorably affect the marketing of the materials packed in this manner.

Another drawback is due to the fact that filling with the materials to be discharged from one side and the loading of the pressurized gases from the other side causes remarkable technical problems which, once again, increase the overall cost.

SUMMARY OF THE INVENTION

The object of this invention is to eliminate the above inconveniences.

According to the present invention this object is achieved by placing on the wall of the internal chamber which holds the fluid material, in an area above the maximum top level of the material inside the chamber and under the discharging valve, a small charging valve which comprises at least one "bypass" hole made along the wall and which puts into communication the internal chamber with the external chamber and a rubber sheath which fits tightly on the wall and closes elastically this hole (or holes). The rubber sheath or ring may be fixed in the upper part of the internal chamber or even along the tube which connects the discharging valve with the internal chamber.

The advantages obtained with the use of the charging valve of this invention consist of the fact that the structure and the application are so simple that they hardly affect the production cost. The cost of the valve itself is in any case easily recovered due to the fact that with its installment it is possible to fill up the containers with the fluids and the pressurized gases holding them in the same position and with no special devices.

BRIEF DESCRIPTION OF THE DRAWINGS

For better understanding the structures and the functional characteristics of the charging valve of this invention, reference is made to the accompanying drawings which illustrate some embodiments of the present invention in which.

Figure 1:
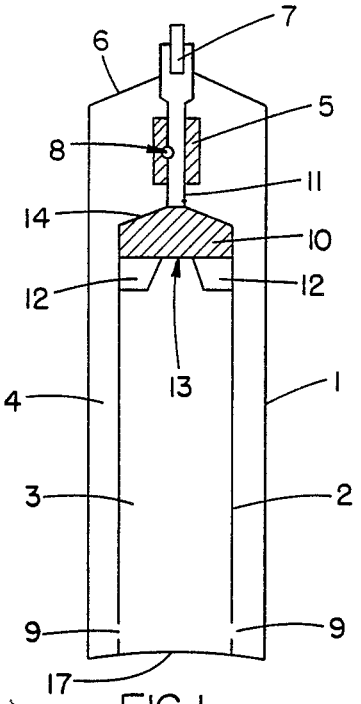
FIG. 1 represents schematically a longitudinal section of a container equipped with the charging valve of this invention fixed on the charging tube.
Figure 2:
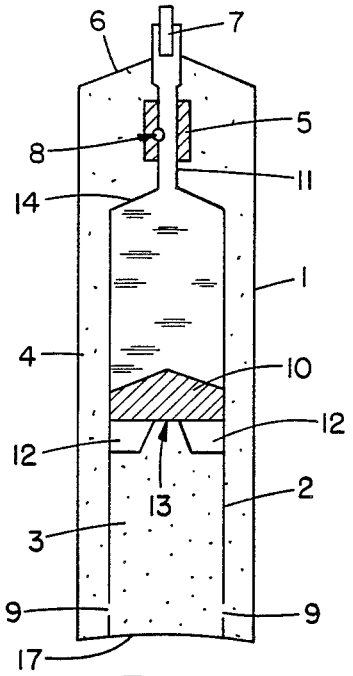
FIGS. 2, 3 and 4 illustrate schematically the longitudinal cross-section of a container according to FIG. 1 but during the charging steps.
Figure 3:
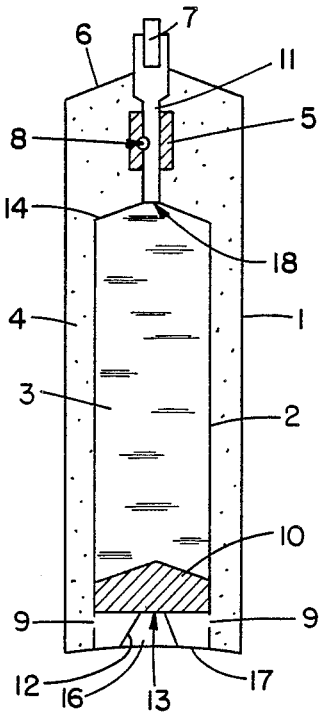
Figure 4:
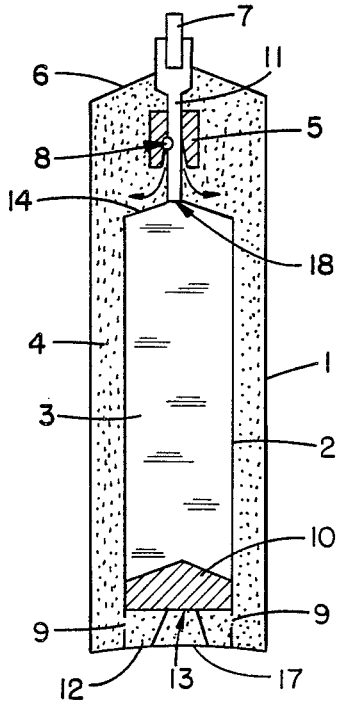

With reference to the FIGURES, the container is constituted by two coaxial tubular bodies (1) and (2) of different diameter and inserted one inside the other to form a first internal chamber (3) and a second external circular (4).

In FIGS. 1, 2, 3 and 4, the internal chamber or tank (3) has at the top a cover (14) which is connected with a tube which ends with the discharging valve (7) fixed on the lid (6). Inside the internal chamber (3) a piston (10) is located with fins (12) at the bottom. The piston is airtight along the chamber.

The lower part of the internal tubular chamber (3) is equipped with a plurality of "bypass" radial holes (9) which connect the two chambers (3) and (4).

Figure 5:
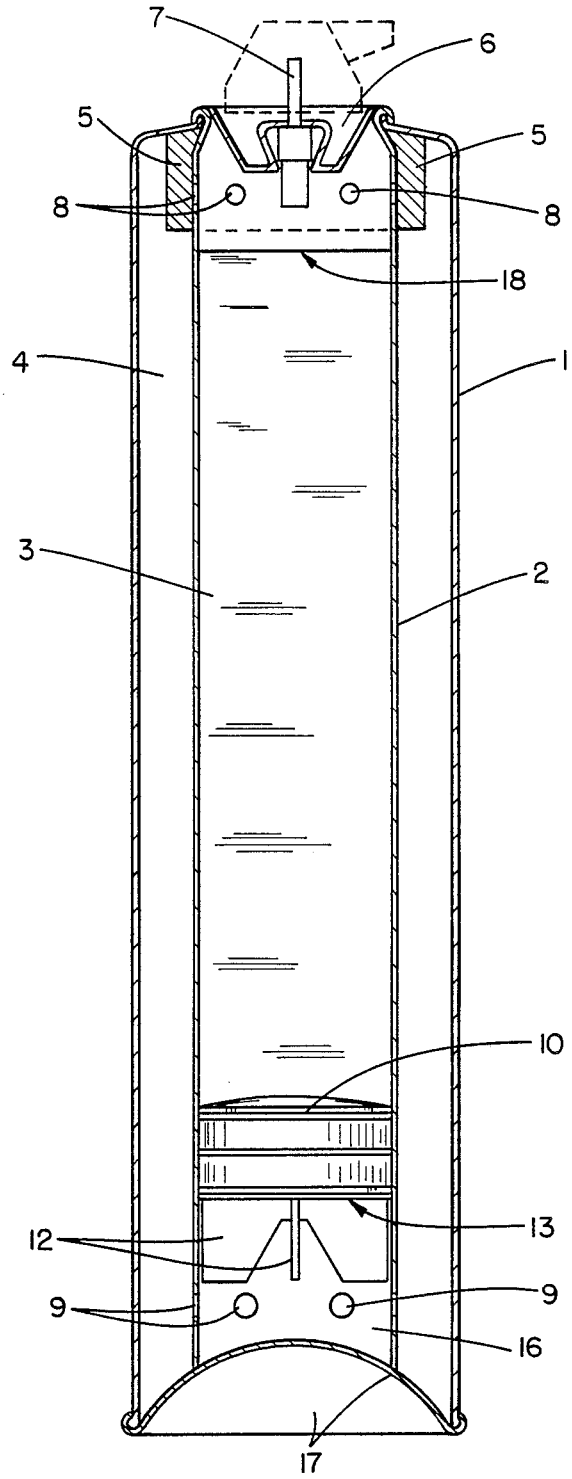
FIG. 5 represents schematically the longitudinal cross-section of a container in which the charging valve of this invention is located on the wall of the tubular internal chamber.

FIG. 5 is different from the other ones because the chambers (3) and (4) are closed on the top by a lid (6) and the discharging valve is fixed on the lid.

According to the present invention, the charging valve includes: at least one "bypass" hole (8) made on the wall of the discharging pipe (11) which connects the internal chamber (3) to the discharging valve (7) or more specifically to the upper part of the tubular body (2) of the internal chamber (3) and a ring-shaped body (5) or sheath of elastic material, for instance, rubber, indian rubber, plastic and the like which will tightly fit and hold the pipe (11) or the tubular body (2) in the presence of the hole (8) closing it in an elastic manner. In any case, the hole (or holes) (8) which connect the two coaxial chambers (3) and (4) in their upper part are made in the area between the maximum level of the discharging fluid (18) and the discharging valve (7). The elastic rubber sheath (5) is coaxial with the discharging valve (7). The lower "bypass" holes (9) are located on the lower part of the tubular body (2) at a distance from the bottom (17) less the height of the fins (12).

The functioning of the charging valve of this invention is the following:

During the charging phase the liquid or fluid materials are injected in the tank (3) with a special syringe which is inserted in the discharging valve (7). While the material is gradually entering in the chamber (3), the piston (10) goes down until its fins (12) will touch the bottom (17). The piston (10) is airtight and stops the material from going through the area below (16). During the lowering, due to the weight of the material, the air under the piston (10) goes through the radial holes (9) and accumulates in the external chamber or tank (4). The fluid to be discharged usually is at ambient pressure. When the tank is completely full, up to level (18) which is lower than the level of the hole (or holes) (8), the pressurized gas or, even better, compressed air is injected from the same syringe, or in the same charging station, or even in a successive station and/or another similar syringe in the same discharging valve (7). The air or gas, finding the chamber (3) full, pushes on the wall of the discharger (11) and through the hole (or holes) (8) on the internal surface of the small valve (5) which, being elastic, opens under the pressure and lets the pressurized gas or air into the external circular chamber (4). This continues until it is completely charged; at the end for interrupting the charging from the outside, the pressurized gas or air present in the circular chamber (4) goes to push on the small charging valve (5) pressing it in such a way that it will close the holes (8). The closing action of the holes is in any case, helped by the flexibility of the small valve (5) which is capable of keeping the hole (or holes) (8) during the entire time of the charging procedures. Once the dual charging is completed, the container is ready for use with the internal tubular chamber (3) full with liquid or fluid material and the external circular chamber (4) is full with pressurized gas or air. By manual operation of the discharging valve (7) the internal chamber (3) comes into contact with the atmosphere and the liquid or fluid contained inside it is forced out by piston (10) which is pushed up by the pressure exerted under its bottom (13) by the pressurized gas or air which from chamber (4) and through the radial holes (9) expands into the lower chamber (16) and pushes on the piston (10). In FIG. 5, the charging valve (5) is applied directly on the external surface of the tubular body (2) constituting the internal chamber (3) in the area between the maximum level of the fluid (18) and the discharging valve (7). The functioning is identical to the one already described above.

I claim:

1. A container for dispensing a fluid under pressure by the action of a propellant gas, comprising an outer tubular body sealed at the lower end, an inner tubular body located coaxially within said outer tubular body and sealed at the lower end, said outer and said inner tubular body defining an external chamber and an internal chamber, said fluid being placed in said internal chamber up to an upper level, said propellant gas being placed in said external chamber, said outer tubular body being longer than said inner tubular body and extending above said inner tubular body, a piston slidable within said inner tubular body and having fins at the bottom thereof, said fins having a height, means for closing the inner tubular body at the upper end, means for closing the external chamber at the upper end, first by-pass radial holes in the lower part of said inner tubular body communicating the internal chamber with the external chamber, said first by-pass radial holes being located at a distance from said lower end less than the height of said fins, a discharging valve projecting from said upper closed end of said inner tubular body to allow the fluid from said internal chamber to escape therefrom, and a charging valve for introducing the propellant into the external chamber, said charging valve comprising a pipe connecting the internal chamber to the discharging valve, at least one second by-pass hole made on the wall of said pipe and a ring-shaped elastic member fitting said pipe, said by-pass hole being located in the area between said upper level of said fluid and said discharging valve, said ring-shaped elastic member closing and overlying said second by-pass hole whereby during the filing operation the fluid is inserted into said internal chamber through said discharging valve and pushes said piston downwardly until said fins touch said lower end, the air in the area under said piston goes through said first radial holes and accumulates in said external chamber and when said propellant gas is introduced into said pipe, said ring-shaped elastic member is expanded and opens, said propellant gas goes threre-through and enters said external chamber, and when said propellant gas has filled said external chamber, said elastic member closes said second by-pass hole.

2. A valve according to claim 1, wherein said rubber sheath (5) is coaxial with said discharging valve (7).

* * * * *